US012753996B1

(12) United States Patent
Blakeley

(10) Patent No.: US 12,753,996 B1
(45) Date of Patent: Oct. 6, 2026

(54) BALLISTIC SHIRT SYSTEM

(71) Applicant: Kenneth Blakeley, El Cajon, CA (US)

(72) Inventor: Kenneth Blakeley, El Cajon, CA (US)

( * ) Notice: Subject to any disclaimer, the term of this patent is extended or adjusted under 35 U.S.C. 154(b) by 0 days.

(21) Appl. No.: 19/172,276

(22) Filed: Apr. 7, 2025

Related U.S. Application Data

(63) Continuation of application No. 15/626,716, filed on Jun. 19, 2017, now Pat. No. 12,281,879.

(51) Int. Cl.
*F41H 5/013* (2006.01)

(52) U.S. Cl.
CPC ..... *F41H 5/013* (2013.01)

(58) Field of Classification Search
CPC ..... F41H 5/013; A41B 1/08; A41D 13/015; A41D 13/0518; A41D 13/0531
See application file for complete search history.

(56) References Cited

U.S. PATENT DOCUMENTS 229,807 A * 7/1880 Coyle ..... A41B 1/00 2/122
4,413,357 A 11/1983 Sacks
4,497,069 A 2/1985 Braunhut
4,507,802 A 4/1985 Small
5,008,959 A 4/1991 Coppage, Jr.
5,247,707 A 9/1993 Parker
5,305,471 A 4/1994 Steele
5,893,370 A 4/1999 Perez
6,088,831 A 7/2000 Jensen
6,175,958 B1 1/2001 Wu
6,405,377 B1 6/2002 Davis
6,766,529 B1 7/2004 Nathan
7,266,850 B1 9/2007 Strum
7,310,824 B2 12/2007 Walsh
7,578,005 B2 8/2009 Vereen
8,430,204 B1 4/2013 Reynolds
8,776,266 B1 7/2014 Metz
2007/0079414 A1 4/2007 Learmont
2007/0192926 A1 8/2007 Fee
2008/0164095 A1 7/2008 Snedeker
2009/0282595 A1* 11/2009 Branson ..... F41H 1/02 2/2.5
2010/0282803 A1 11/2010 Simmons
2011/0131694 A1 6/2011 Fearon
2012/0185988 A1 7/2012 Herbener
2013/0047312 A1 2/2013 Wilson
2014/0090141 A1 4/2014 Friedrich
2014/0101810 A1 4/2014 Tirard
2014/0109285 A1 4/2014 Amarasiriwardena
(Continued)

*Primary Examiner* — Uyen T Nguyen
(74) *Attorney, Agent, or Firm* — Michele V. Frank; Venable LLP

(57) ABSTRACT

A shirt system for supporting body armor includes an inner shirt with an inner shirt pocket attached to an inner shirt front panel, an outer shirt with an outer shirt pocket attached to an outer shirt rear panel, a first ballistic panel of the body armor disposed within the inner shirt pocket, a second ballistic panel of the body armor disposed within the outer shirt pocket, and a first strap and a second strap connected to the inner shirt pocket and the outer shirt pocket. An outer shirt yoke includes an outer shirt yoke opening that is configured to receive the first strap, and the outer shirt rear panel includes an outer shirt rear panel opening that is configured to receive the second strap.

20 Claims, 17 Drawing Sheets

(56) References Cited

U.S. PATENT DOCUMENTS

| | | | | |
|---|---|---|---|---|
| 2014/0239030 | A1 | 8/2014 | Roth | |
| 2014/0259250 | A1 | 9/2014 | Strum | |
| 2014/0263517 | A1* | 9/2014 | Redli | A41D 13/0007 224/576 |
| 2015/0059042 | A1 | 3/2015 | Aquino | |
| 2015/0196077 | A1 | 7/2015 | McIntire, Jr. | |
| 2015/0374044 | A1* | 12/2015 | Kim | A41D 27/08 2/300 |
| 2017/0160058 | A1 | 6/2017 | Limpisvasti | |
| 2018/0160744 | A1 | 6/2018 | Blauer | |

* cited by examiner

BALLISTIC SHIRT SYSTEM

CROSS-REFERENCE TO RELATED APPLICATIONS

This application is a continuation of U.S. patent application Ser. No. 15/626,719, filed Jun. 19, 2017, the entire content of which is incorporated herein by reference.

TECHNICAL FIELD

The present application relates to a ballistic shirt system and related methods. More specifically, the present application relates to a shirt system which may receive one or more ballistic panels for protecting the wearer.

BACKGROUND

Ballistic panels are used in many professions, including police officers, secret service agents, medical professionals, politicians, and public personalities. These ballistic panels commonly take the form of bullet proof vests to be worn beneath the wearer's clothing. Ballistic panels within shirts are also known. However, known vests and shirts are bulky and hot, creating an ill-fitting look and discomfort for the user. The bulky and hot nature of known ballistic panels makes it difficult for the wearer to move and operate in an efficient manner which can be essential in many professions, such as medical professionals, police officers, and secret service agents.

SUMMARY

According to an embodiment, a shirt system may include an inner shirt including a first pocket adapted to receive a first ballistic panel, an outer shirt including a second pocket adapted to receive a second ballistic panel, and at least one connector adapted to extend from the first pocket to the second pocket. The first pocket is located on a front panel of the inner shirt and the second pocket is located on a rear panel of the outer shirt.

According to an embodiment, a shirt system may include an inner shirt including a first pocket located on a front panel of the inner shirt, an outer shirt including a second pocket located on a rear panel of the outer shirt, a first ballistic panel received in the first pocket, a second ballistic panel received in the second pocket, and at least one connector adapted to attach the first pocket to the second pocket.

According to an embodiment, a shirt may include a front panel, a rear panel, a pocket located on at least one of the front panel or the rear panel that is adapted to receive a ballistic panel, at least one connector attached to the pocket and adapted to connect to a second shirt, and a closing member adapted to close the pocket.

According to an embodiment, a method of donning a shirt system for supporting body armor may include installing a first ballistic panel in a first pocket of an inner shirt, installing a second ballistic panel in a second pocket of an outer shirt, dressing a user in the inner shirt, dressing the user in the outer shirt, and connecting the first pocket to the second pocket.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed, and other methods developed without departing from the spirit and scope of the invention. All references cited herein are incorporated by reference as if each had been individually incorporated.

Embodiments of the present invention relate to ballistic shirts and ballistic shirt systems which may be lightweight and breathable when clothing a wearer. Embodiments may provide an inner shirt including a ballistic panel and an outer shirt including a ballistic panel. Embodiments may provide a side ballistic panel. The inner shirt may be connected to the outer shirt with a removeable connector. The removeable connector may be a hook-and-pile fastener, a button, a zipper, a strap, an adjustable strap, a tie, or a clip. The removeable connector may connect a pocket on the inner shirt to a pocket on the outer shirt. The pockets may each receive a ballistic panel. The inner shirt and the outer shirt may include a moisture-wicking material, respectively. The inner shirt and/or the outer shirt may be an undershirt, a t-shirt, an athletic shirt, a tank top, a dress shirt, a tuxedo shirt, a polo shirt, short-sleeve shirt, a long-sleeve shirt, a blouse, a vest, a military uniform shirt, a secret service uniform shirt, a firefighter uniform shirt, a police officer uniform shirt, a security officer uniform shirt, or a medical worker shirt.

Figure 1:
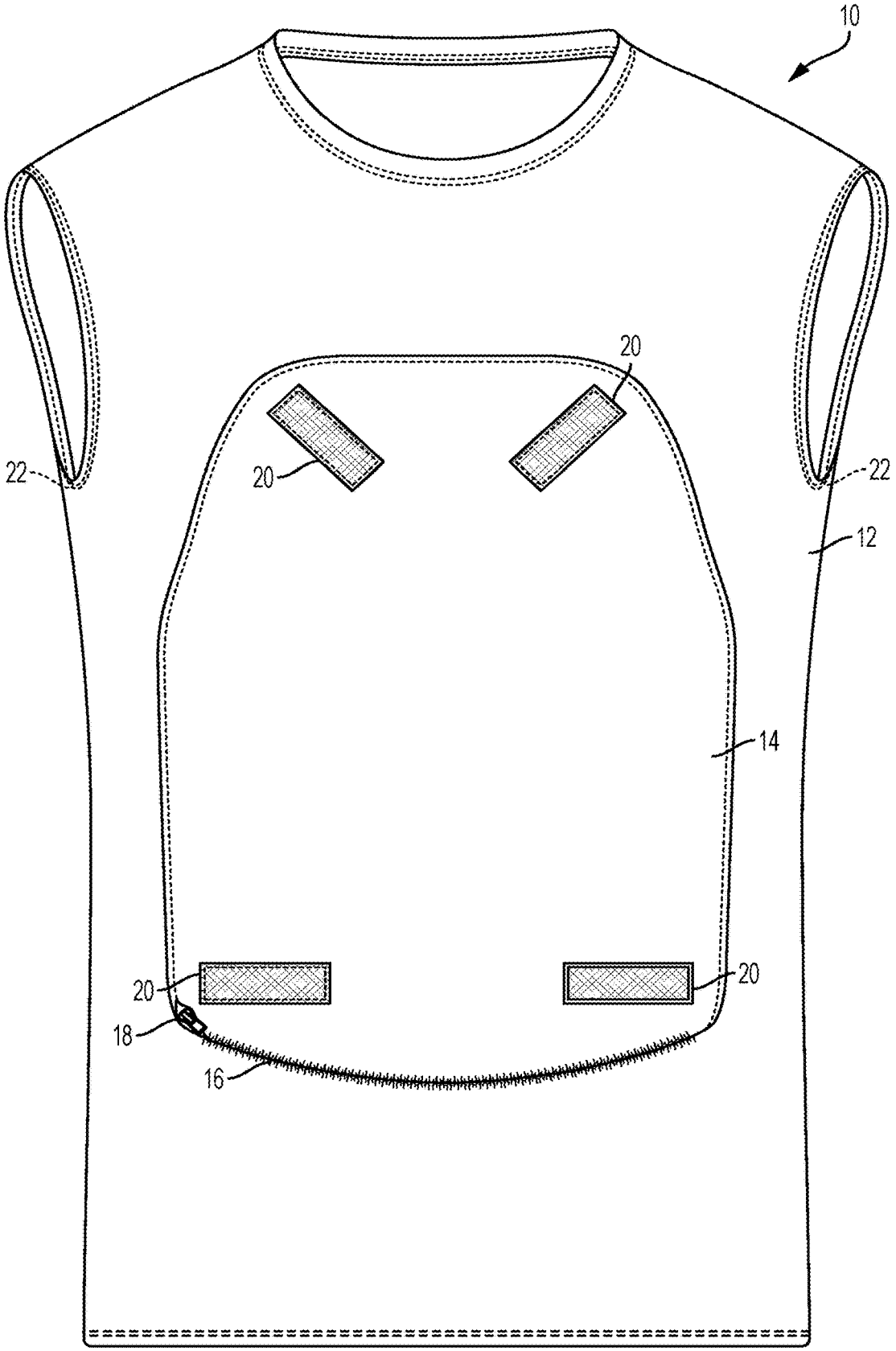
FIG. 1 is a front view of an inner shirt of a ballistic shirt system, according to an embodiment.

Referring to FIG. 1, an embodiment of an inner shirt 10 according to the present invention is shown. Inner shirt 10 may include a front panel 12 and a rear panel (not depicted). The front panel 12 may comprise a pocket 14. The pocket 14 may be formed integrally with the front panel 12 of the inner shirt 10. The pocket 14 may also be formed as a separate sleeve connected to the inner shirt 10 in a manner known in the art, such as stitching or adhesion. The pocket 14 may be closed on all sides except a lower side which may have an opening 16 to receive a ballistic panel. The opening 16 of pocket 14 may include a closing member 18 for closing pocket 14. Although the opening 16 and closing member 18 are described and shown on the lower side of the pocket 14, other locations of the opening 16 and closing member 18 may be possible. For example, the opening 16 and closing member 18 may be located on a left side, right side, top side, or middle portion of the pocket 14. Although closing member 18 is depicted as a zipper, other closing members are possible. For example, the closing member may be Velcro® (also known as a hook-and-pile fastener), a button, buckle, or a snap.

Figure 4:
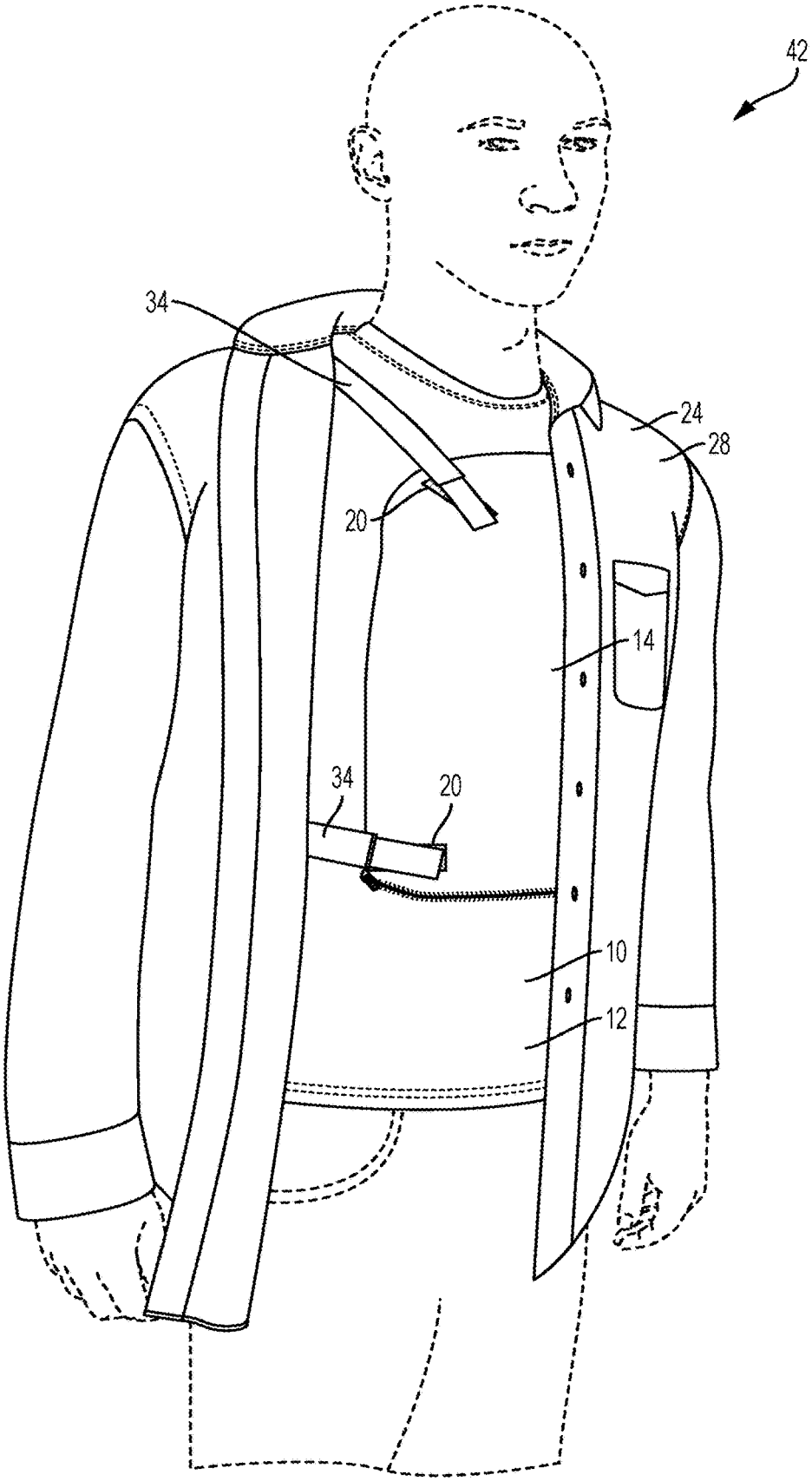
FIG. 4 is a perspective view of a ballistic shirt system, according to an embodiment, clothing a wearer.

With continued reference to FIG. 1, the pocket 14 may comprise connectors 20. Although four connectors 20 are depicted, any number of connectors may be considered, even a single connector. The connectors 20 may be Velcro®. The connectors 20 may also be a button, zipper, strap, adjustable strap, tie, buckle, or clip. The connectors 20 may be attached to the pocket 14 of the inner shirt 10 in any known manner, such as stitching or adhesion. Any number of locations of the connectors 20 on pocket 14 may be possible. For example, the connectors may be located on an upper portion or lower portion of pocket 14. The connectors may also be located on one or both sides of pocket 14. Referring briefly to FIG. 4, it can be appreciated that straps 34 may attach to connectors 20.

Figure 1A:
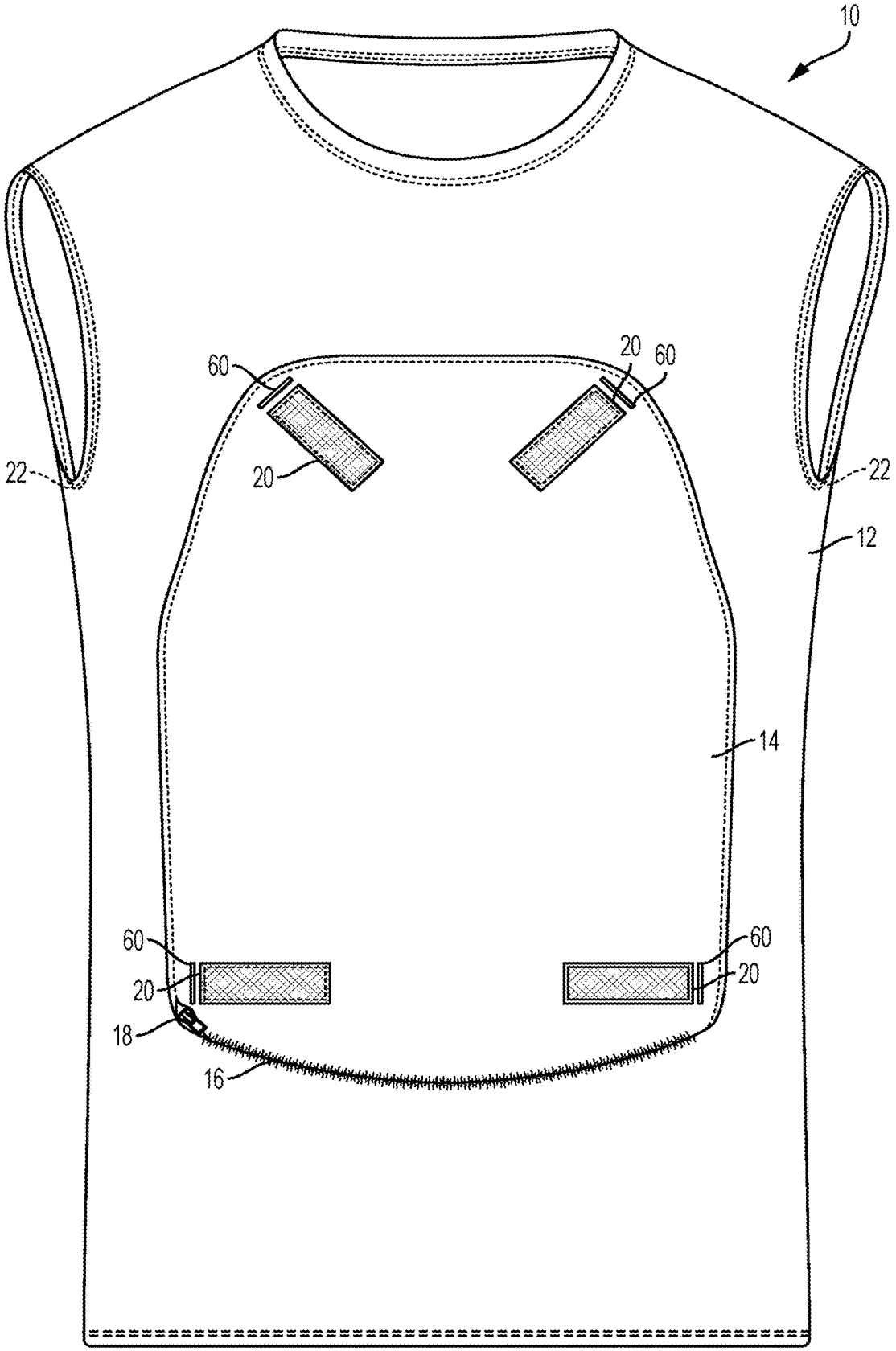
FIG. 1A is a front view of an inner shirt of a ballistic shirt system, according to an embodiment.
Figure 9:
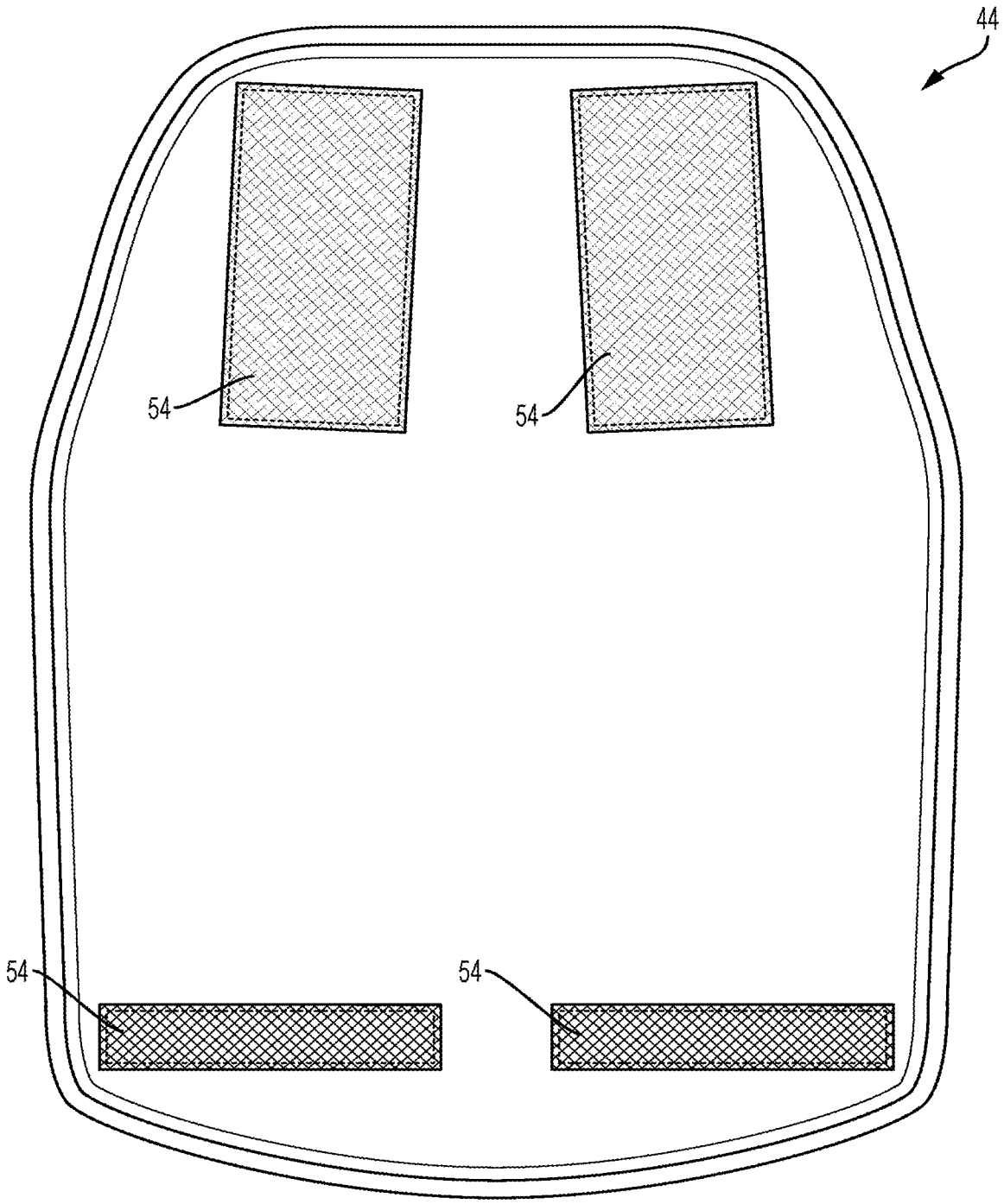
FIG. 9 is a front view of a ballistic panel for an inner shirt of a ballistic shirt system, according to an embodiment.

Alternatively, as seen in FIG. 1A, the pocket 14 may be provided with openings 60 in addition to connectors 20 for an additional location to thread straps 34. The openings 60 may be provided instead of connectors 20 for a different location to thread straps 34. The openings 60 may allow for the straps 34 (FIG. 4A) to be connected directly to connectors 54 on the ballistic panel 44 (FIG. 9). That is, when viewing as worn by a user (FIG. 4A), the straps 34 may enter respective openings 60 and connect to the ballistic panel 44 located within the pocket 14. Although the openings 60 are depicted as aligning with connectors 20, it will be appreciated that openings 60 may be located in any number of locations on pocket 14 such that they may align with connectors 54 on the ballistic panel 44 located within the pocket 14. Additionally, although only four openings 60 are depicted, any number of openings may be provided.

Referring again to FIG. 1, the inner shirt 10 may be any high performance material, such as a microfiber polyester fabric or a moisture-wicking material. Suitable materials may be Nike Dri-FIT™, Coolmax®, or other high performance and breathable fabrics. The inner shirt 10 may entirely comprise the high performance material or may comprise portions of moisture-wicking material. For example, an underarm portion 22, front panel 12, pocket 14, and/or rear panel may comprise a high performance material. The inner shirt may be a short-sleeve shirt, a long-sleeve shirt, an athletic shirt, an undershirt, a t-shirt, or a tank top. Although the pocket 14 is depicted in a central portion of the front panel 12, other locations are possible. For example, the pocket 14 may be located on the rear panel. The pocket 14 may be located on an upper or lower portion of the front panel 12 and/or rear panel. Additionally, the pocket 14 may be a plurality of pockets for receiving a plurality of ballistic panels.

Figure 2:
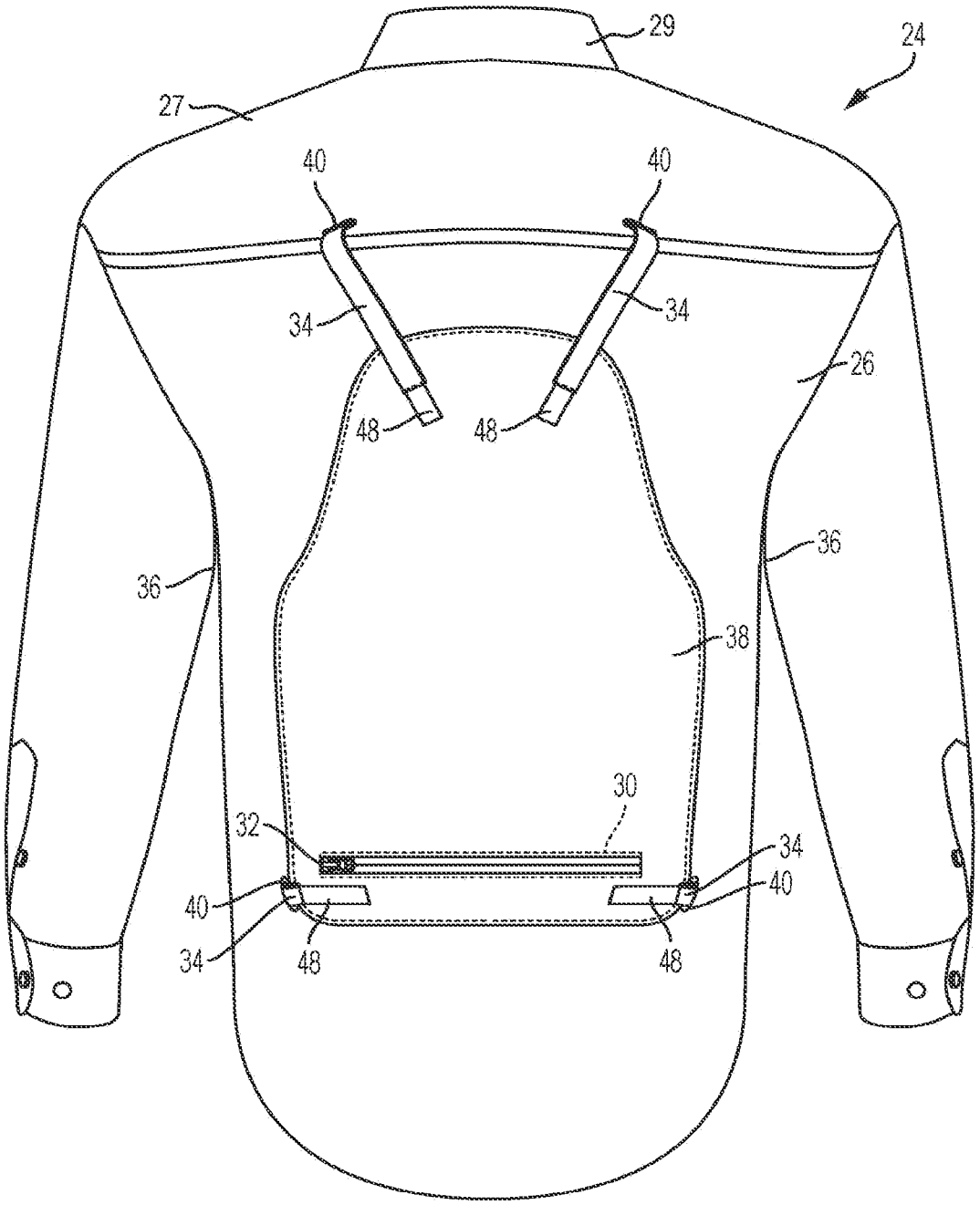
FIG. 2 is a back view of an outer shirt of a ballistic shirt system, according to an embodiment.

Referring to FIG. 2, an embodiment of an outer shirt 24 according to the present invention is shown. Outer shirt 24 may include a rear panel 26, a front panel 28 (FIG. 3), a yoke 27, and a collar 29. The rear panel 26 may comprise a pocket 38. The pocket 38 may be formed integrally with the rear panel 26 of the outer shirt 24. The pocket 38 may also be formed as a separate sleeve connected to the outer shirt 24 in a manner known in the art, such as stitching or adhesion. The pocket 38 may be closed on all sides with an opening 30 for receiving a ballistic panel located near a lower portion of the pocket 38. The opening 30 may be closed with a closing member 32. Although the opening 30 and closing member 32 are described and shown on the lower portion of pocket 38, other locations of opening 30 and closing member 32 may be possible. For example, the opening 30 and closing member 32 may be located on a left side, right side, top side, or middle portion of the pocket 38. Although closing member 32 is depicted as a zipper, other closing members are possible. For example, the closing member may be Velcro® (also known as a hook-and-pile fastener), a button, buckle, or a snap.

With continued reference to FIG. 2, the pocket 38 may comprise connectors 48. Although four connectors 48 are depicted, any number of connectors 48 may be considered, even a single connector. The connectors 48 may be Velcro®. The connectors 48 may also be a button, zipper, strap, adjustable strap, tie, buckle, or clip. The connectors 48 may be attached to the pocket 38 of outer shirt 24 in any known manner, such as stitching or adhesion. Any number of locations of the connectors 48 on pocket 38 may be possible. For example, the connectors 48 may be located on an upper portion or lower portion of pocket 38. The connectors 48 may also be located on one or both sides of pocket 38. The connectors 48 may attach to one or more straps 34. For example, the straps 34 may attach on the outer shirt to connector 48 (FIG. 2) and on the inner shirt to connector 20 (FIG. 4). The straps 34 may be adapted to thread through openings 40 in the outer shirt 24. Although four openings 40 are depicted, any number of openings 40 may be considered. The number of openings 40 may correspond with a location and number of connectors 48 for facilitating connection of the pocket 38 to the pocket 14, as will be described below. The straps 34 may attach to connectors 48 on pocket 38 of the outer shirt 24 and/or to connectors 20 on pocket 14 of the inner shirt 10 via Velcro® or other fastener which corresponds to the type of fastener provided by connectors 20 and 48. Exemplary fasteners are a button, zipper, tie, buckle, or clip. In this manner, the straps 34 may be removable from both pockets 14, 38 and thus from inner shirt 10 and outer shirt 24. The removable nature of the straps 34 and ballistic panels may allow for the shirts to be laundered, ironed, etc. without damaging the straps, shirt, or ballistic panels.

Figure 3:
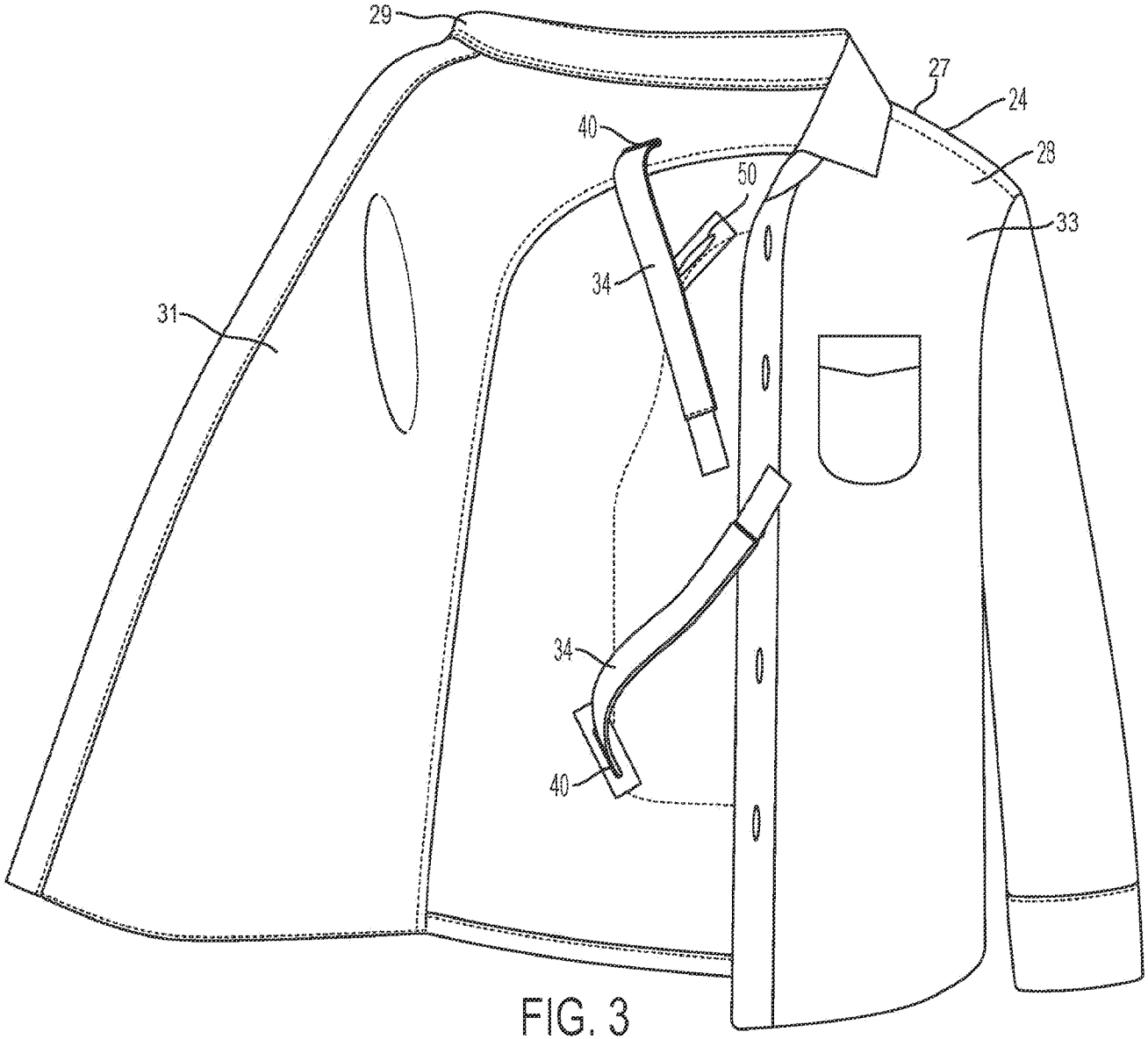
FIG. 3 is a front view of the outer shirt of FIG. 2.

Referring to FIGS. 2 and 3, embodiments of outer shirt 24 can comprise a high performance material, such as a microfiber polyester fabric or a moisture-wicking material. Suitable materials may be Nike Dri-FIT™, Coolmax®, or other high performance and breathable fabrics. The outer shirt 24 may entirely comprise the high performance material or may comprise portions of high performance material. For example, an underarm portion 36, front panel 28, pocket 38 (FIG. 3), and/or rear panel 26 may comprise a high performance material. The outer shirt may be a dress shirt, a tuxedo shirt, a polo shirt, a short-sleeve shirt, a long-sleeve shirt, a blouse, a vest, a military uniform shirt, a secret service uniform shirt, a firefighter uniform shirt, a police officer uniform shirt, a security officer uniform shirt, or a medical worker shirt. The shirt may alternatively be made from non-high performance materials. Although the pocket 38 is depicted in a central portion of the rear panel 26, other locations are possible. For example, the pocket 38 may be located on the front panel 28. The pocket 38 may be located on an upper or lower portion of the rear panel 26 and/or front panel 28. Additionally, the pocket 38 may be a plurality of pockets for receiving a plurality of ballistic panels.

Figure 2A:
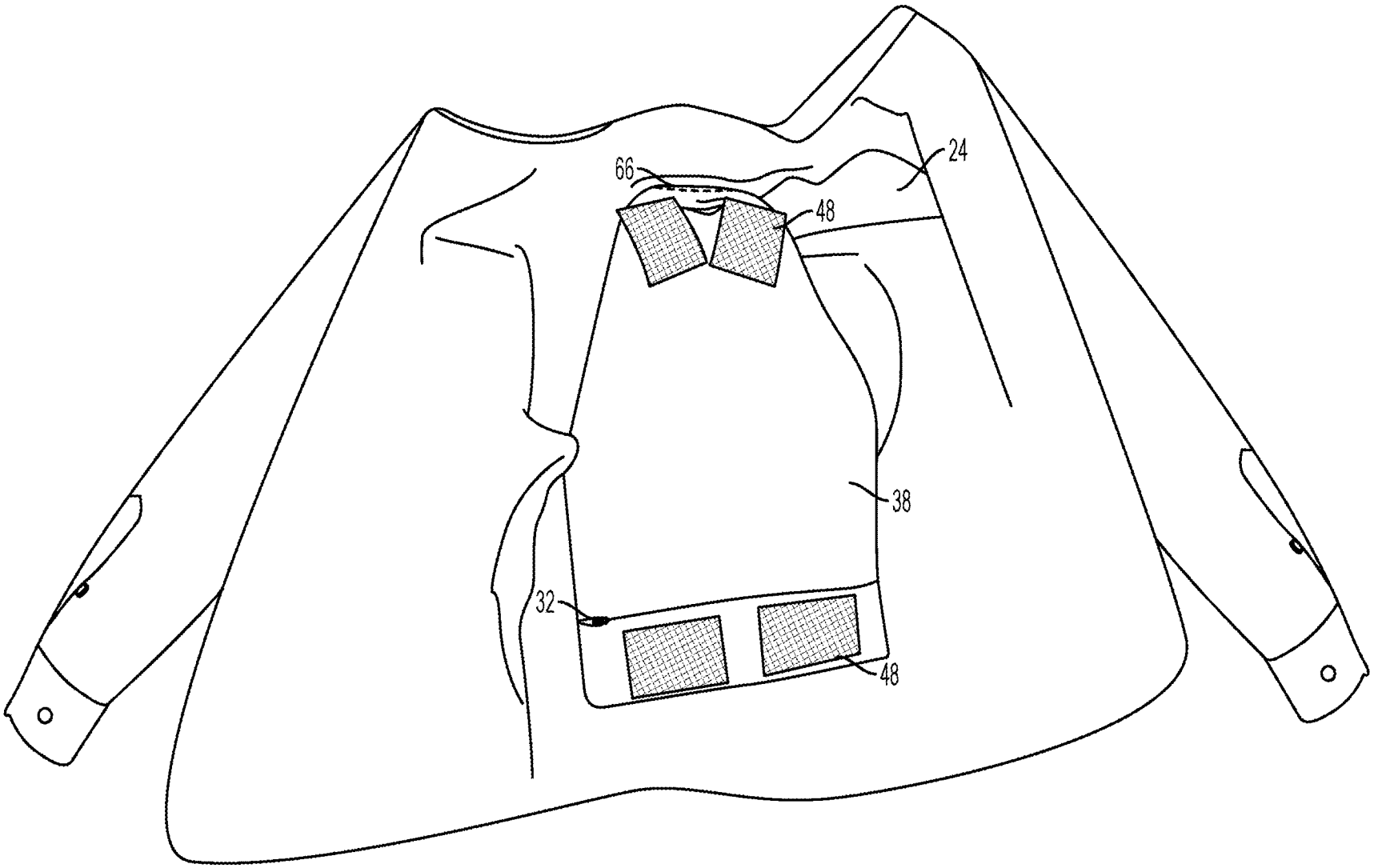
FIG. 2A is a front view of an outer shirt of a ballistic shirt system, according to an embodiment.

Referring to FIG. 2A, the pocket 38 may be located on a front side of the rear panel 26 of the outer shirt 24. The pocket 38 may be stitched around the circumference, as in FIG. 2. Alternatively, the pocket 38 may be stitched along a top stitched portion 66 such that the only connection point between the pocket 38 and outer shirt 24 is the stitched portion 66. Alternatives to stitching may be used, such as adhering or otherwise fastening the pocket 38 to the shirt 24. As can be appreciated from FIG. 2A, the closing member 32 of the pocket 38 may now be located on the inner side of shirt 24. Additionally, connectors 48 may also now be located on the inner side of the shirt 24. Thus, in donning, a user will insert the ballistic panel 46 (FIG. 10) into pocket 38 and move closing member 32 to a closed position. The user may attach straps 34 to the connectors 48. The user may then don the outer shirt 24 and prior to buttoning the front panels, may attach straps 34 to the inner shirt 10 in a manner described herein. Though woven strips 52 are not depicted in FIG. 2A, it is understood that they may be attached on the inner side of outer shirt 24 or on the inner shirt 10 in one of the manners described herein to further secure the straps 34 and thus the ballistic panels 44 and 46.

Referring to FIG. 3, a front view of the outer shirt 24 according to the embodiment of FIG. 2 is shown. As mentioned previously, the outer shirt 24 may comprise a front panel 28. In the illustrated embodiment, the front panel 28 comprises two panels, a first front panel 31 and a second front panel 33, which may be connected together in a manner known in the art, such as a zipper, button(s), or snap(s). The first front panel 31 is depicted in FIG. 3 as being pulled aside to facilitate understanding of the straps 34 and openings 40. Straps 34 are depicted threaded through openings 40 for connection to the pocket 14 as will be described below. The straps 34 may extend from pocket 38 on the rear panel 26 of outer shirt 24 through openings 40 to the opposing side of rear panel 26 (e.g. from the exterior to the interior of the outer shirt 24).

Figure 3A:
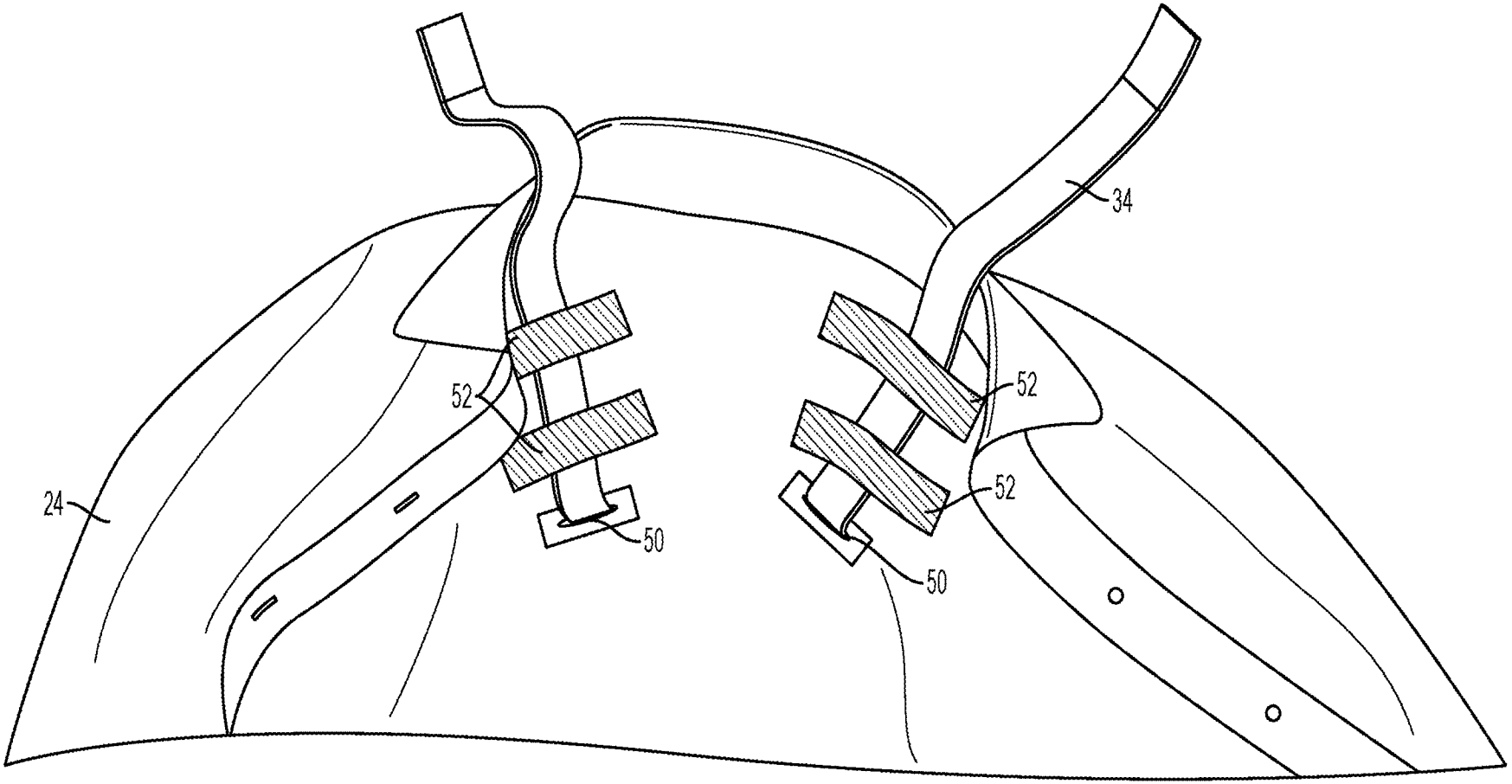
FIG. 3A is a front view of the outer shirt of FIG. 2 showing an alternative location for a connection.

Alternatively, with continued reference to FIG. 3, openings 50 may be provided in addition to openings 40 for an additional location to thread straps 34. The openings 50 may be provided instead of openings 40 for a different location to thread straps 34. Referring to FIGS. 3 and 3A, the alternative location for openings 50 is shown at a top portion of the pocket 38. The openings 50 may be located on the interior of the outer shirt 24. That is, the openings 50 may extend through the inner layer of the outer shirt 24 or pocket 38 (FIGS. 3 and 3A) but not through an outer layer of the outer shirt 24 or pocket 38 (FIG. 2). In this manner, straps 34 may attach directly to the ballistic panel 46 (FIG. 10) via connectors 54 (FIG. 10) and then be threaded through openings 50, e.g. on the inner surface of the pocket.

Figure 4A:
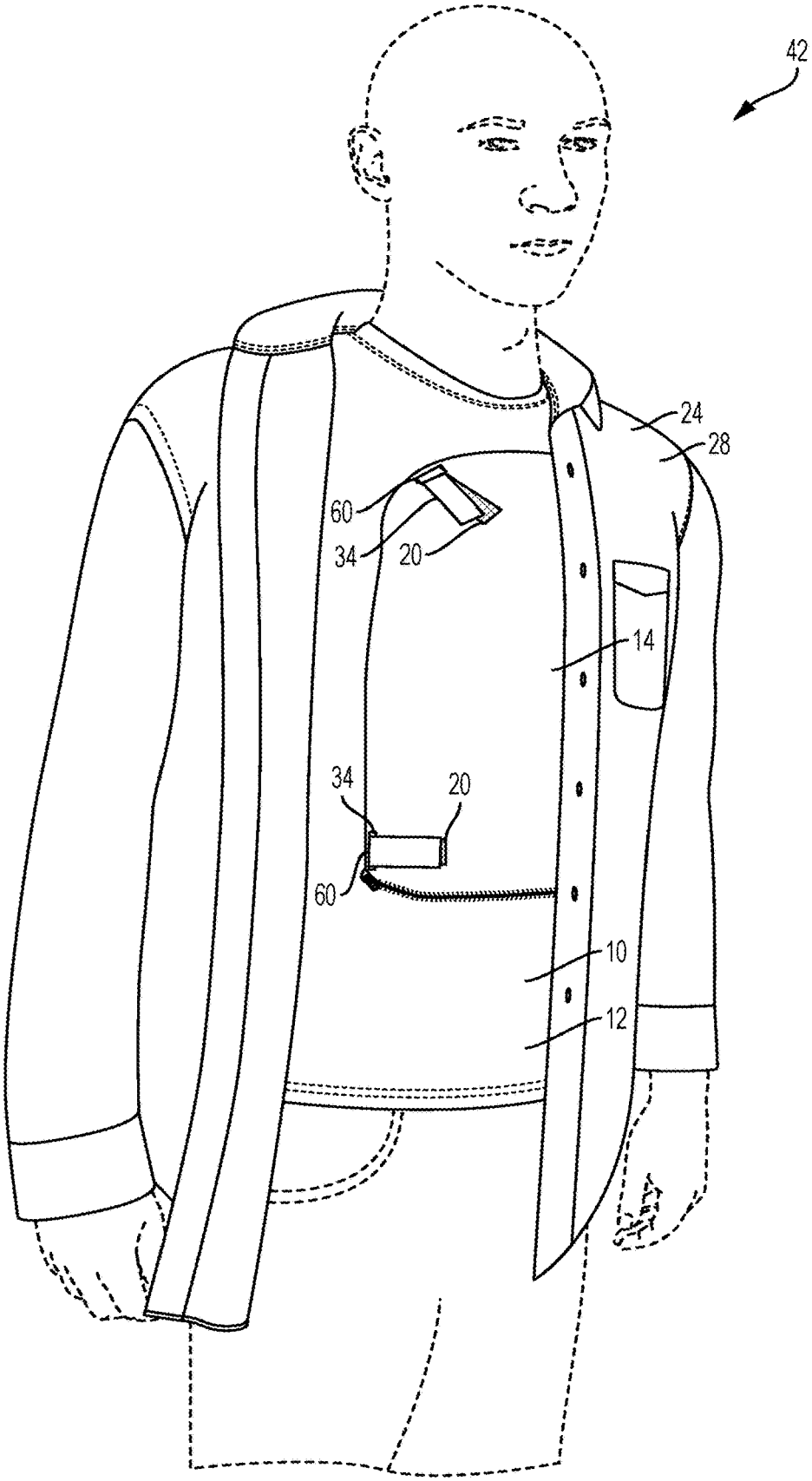
FIG. 4A is a perspective view of a ballistic shirt system, according to an embodiment, clothing a wearer.

Referring to FIG. 3A, the straps 34 may rest on the wearer's shoulder and be attached to the pocket 14 and/or directly to the ballistic panel 44, in the manner to be described with relation to FIGS. 4 and 4A. The outer shirt 24 may be provided with one or more strips of woven strips 52, such as MOLLE webbing. The woven strips 52 may be any other woven, webbed, fabric, or reinforcing material. The ends of strips 52 may be stitched or otherwise adhered to the outer shirt 24 (or other component of the shirt system) such that straps 34 may be laced through the strips 52. The straps 34 may be threaded through the woven strips 52 prior to being attached to the pocket 14. Although four strips of woven strips 52 are depicted, it is understood that more or less strips may be used. Additionally, the straps 34 may be woven through one or more of the strips to provide stability for the system based on the wearer's specific measurements (such as shoulder height). For example, four strips 52 may be provided (as depicted in FIG. 3A) or alternatively six or more strips 52 may be provided. A wearer may thread the connector through one or two (or three in the case of six strips 52) of the strips 52 based on the desired location and stability of the strap 34.

Although only depicted with respect to the upper connection of the outer shirt 24, it is understood that similar openings may be provided in the torso region. That is, openings 40 (FIG. 3) in the torso region of the shirt may extend through the inner layer of the outer shirt 24 or pocket 38 but not through an outer layer of the outer shirt 24 or pocket 38. The straps 34 may attach to connectors 54 in the torso region (FIG. 10) and then be threaded through openings 40 and around the wearer's torso to connect to pocket 14. In this manner, in the rear view of FIG. 2, the openings 40 would not be seen. Similar to the upper openings 50, the torso region may be provided with one or more strips of woven strips 52 to stabilize the shirt system. A wearer may thread the strap 34 through one or more woven strips 52 in the torso region based on the wearer's torso size to stabilize the ballistic panels.

Figure 3B:
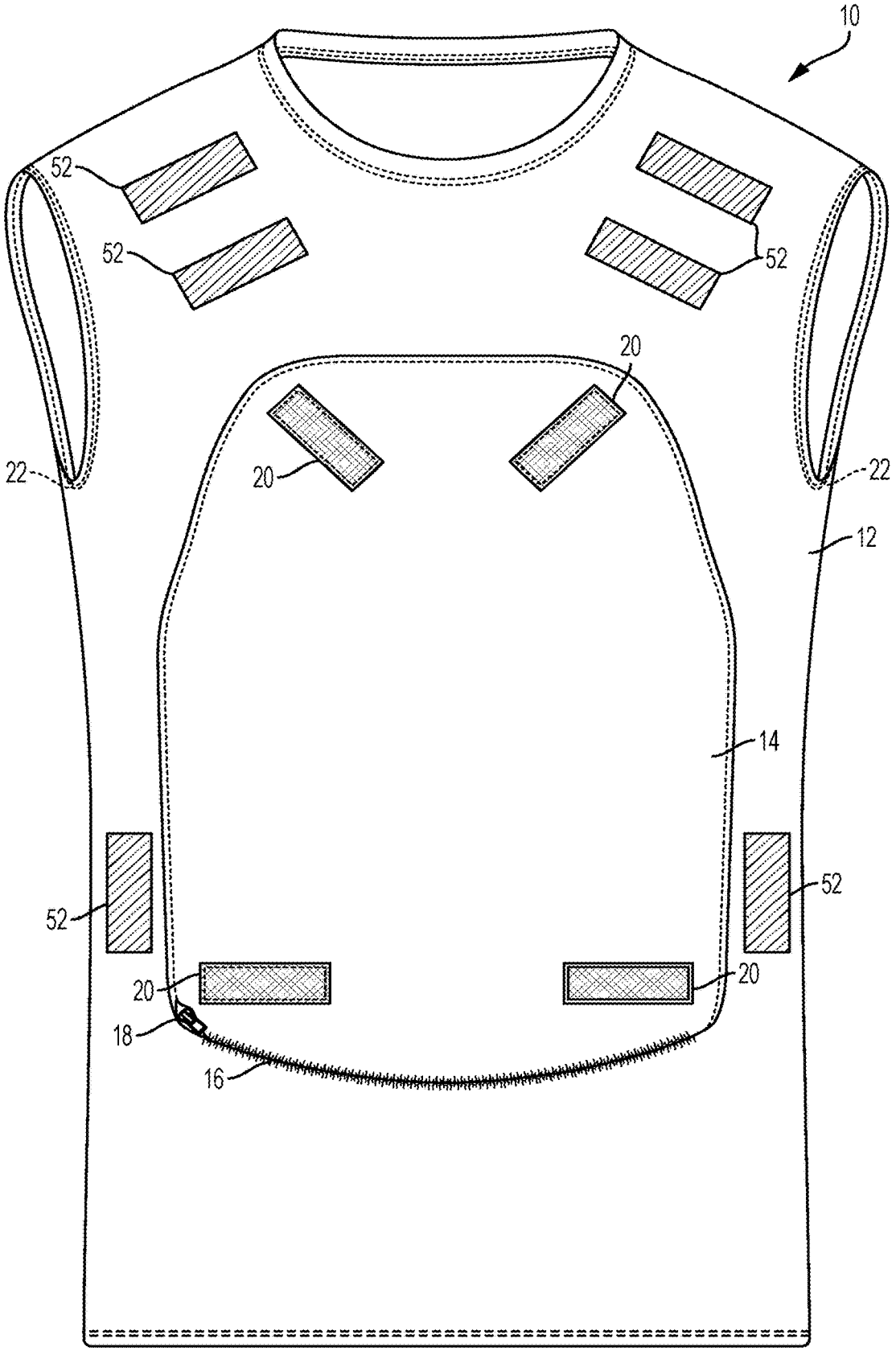
FIG. 3B is a front view of the inner shirt of FIG. 1 showing woven webbing strips.

Alternatively, as shown in FIG. 3B, the strips 52 may be provided on the inner shirt 10. The straps 34 can be threaded through the openings 40 and/or 50 prior to donning the outer shirt 24. Once the user has dressed in inner shirt 10 and outer shirt 24, the user may thread the straps 34 through the strips 52 located on inner shirt 10 prior to connection with pocket 14. Although four strips 52 in the upper region of inner shirt 10 and two strips in the torso region of inner shirt 10 are depicted, any number of strips 52 may be provided. As has previously been discussed, a wearer may thread the straps 34 through one or more of the strips 52 prior to connection to pocket 14.

Referring to FIG. 4, an exemplary shirt system 42 according to the present invention is shown and a method of dressing a wearer in the shirt system 42 may now be understood. The shirt system 42 may comprise the inner shirt 10 and the outer shirt 24. The inner shirt 10 may be an undershirt of a high performance material. The outer shirt 24 may be a dress shirt generally constructed of a conventional cotton or cotton-blend woven fabric, except for at least a portion of the rear panel 26 which may be constructed of a high performance material. The cotton or cotton-blend woven fabric may be, for example, broadcloth, twill, oxford, or other known fabric. The high performance material may be any of the materials previously described, including a microfiber polyester fabric, a moisture-wicking material, Nike Dri-FIT™, Coolmax®, or other high performance and breathable fabrics.

With continued reference to FIG. 4, the wearer may dress in inner shirt 10 in a known manner with front panel 12 and pocket 14 adjacent the wearer's chest, as may be seen in FIG. 4. A ballistic panel may be secured in pocket 14, e.g., by insertion through opening 16 using closing member 18. The ballistic panel may be secured in pocket 14 before or after dressing in the inner shirt 10. After inner shirt 10 is placed on the wearer, the wearer may then dress in outer shirt 24, in a known manner. A ballistic panel may be secured in pocket 38 of the outer shirt 24, e.g. by insertion through opening 30 using closing member 32. The ballistic panel may be secured in pocket 38 before or after dressing in the outer shirt 24.

Prior to securing the two panels of front panel 28, the wearer may connect pocket 38 (FIG. 2) to pocket 14. A strap 34 may be attached to connector 48 (FIG. 2) or 54 (FIG. 10) before or after the ballistic panel is secured in pocket 38 of the outer shirt 24. To connect the pockets 14 and 38, the wearer may take a first strap 34 from the pocket 38 on the rear panel 26 of outer shirt 24 and thread it through a corresponding opening 40 (FIG. 2) or 50 (FIG. 3A). Once strap 34 is threaded through opening 40 or 50, the wearer may then attach strap 34 to connector 20, such that pocket 38 is connected to pocket 14. If strips 52 are provided, the wearer may lace the strap 34 through strip(s) 52 prior to connecting to pocket 14. The wearer may then repeat these steps as necessary until all straps 34 are threaded through openings 40 and secured to connectors 20. Once attached, the straps 34, connectors 48, and connectors 20 will secure the pocket 38 to the pocket 14 such that the ballistic panels 44 and 46 (FIGS. 9 and 10) located within the pockets 38 and 14, respectively, are secured at the proper location on the wearer to ensure protection of the wearer. The straps 34 may be threaded through the openings on the outer shirt 24 before or after donning the outer shirt 24. The straps 34 may be connected to at least one of the pocket 38, pocket 14, ballistic panel 44, or ballistic panel 46 before or after donning the inner shirt and/or outer shirt. Alternatively, the straps 34 may be connected after donning both the inner shirt 10 and the outer shirt 24.

Referring now to FIG. 4A, it may be appreciated that the wearer may dress in the shirt system 42 in a similar manner as described with respect to FIG. 4. However, instead of connecting strap 34 to connector 20, the user may thread the strap 34 through the opening 60 on the pocket 14 of the inner shirt 10. The user may secure the strap 34 to the connector 54 (FIG. 9) of the ballistic panel 44. The user may connect the strap 34 to the connector 54 before the ballistic panel 44 is inserted into the pocket 14 or after the ballistic panel 44 is inserted into the pocket 14. The ballistic panel 44 and strap 34 may be secured within pocket 14 before or after donning the inner shirt 10.

Figure 5:
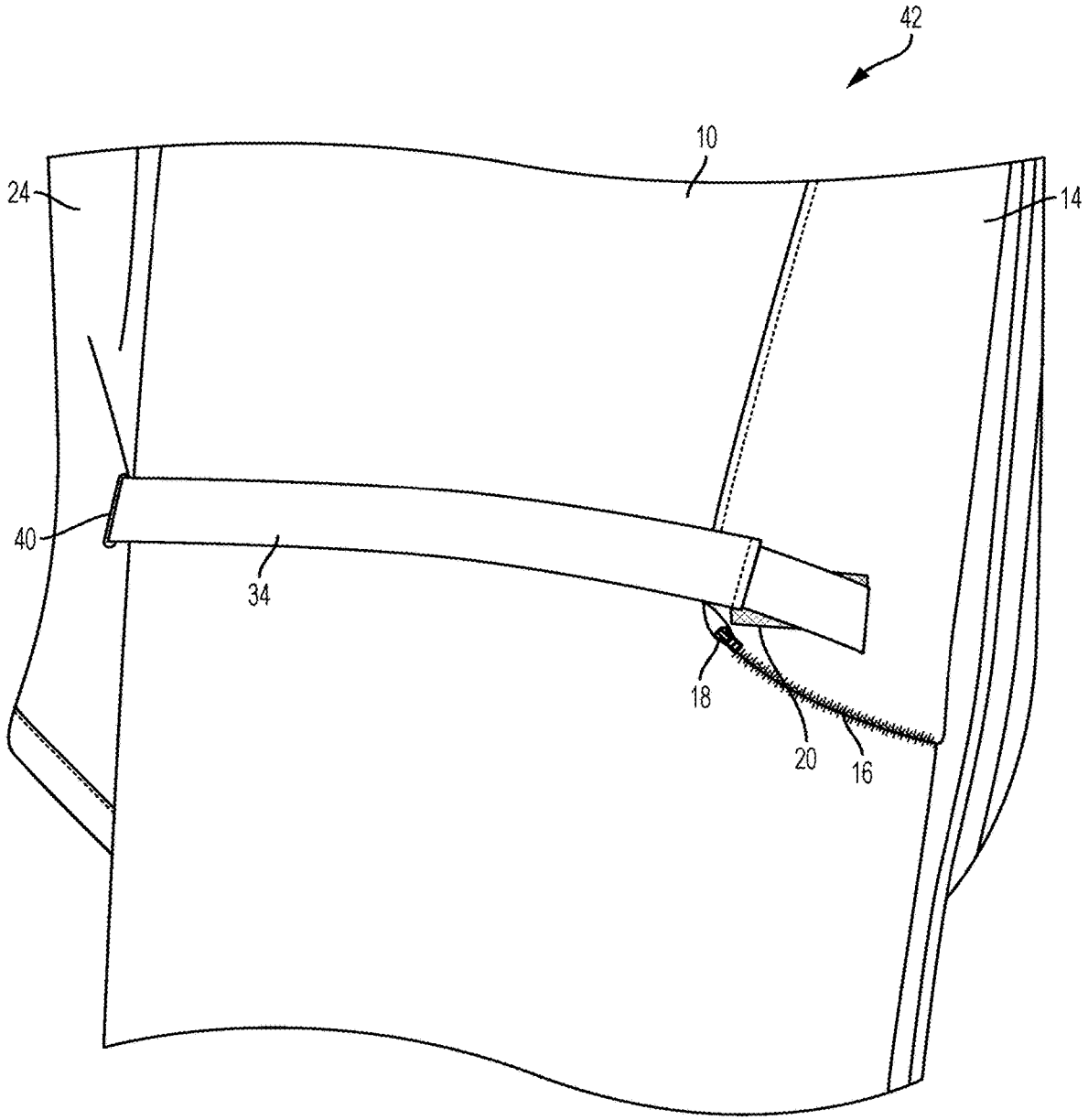
FIG. 5 is a detail view of a lower portion of the ballistic shirt system on a wearer, according to the embodiment of FIG. 4.

Referring to FIG. 5, a detail view of a lower portion of the shirt system 42 is shown. In this view, strap 34 located on a lower portion of the outer shirt 24 (near to the wearer's torso in FIG. 4) can be seen threaded through opening 40 and attached to connector 20 on the pocket 14 of the inner shirt 10. The openings 40 and/or 50 may comprises a hole or slit that is reinforced by stitching or another layer of material attached thereto.

Figure 6:
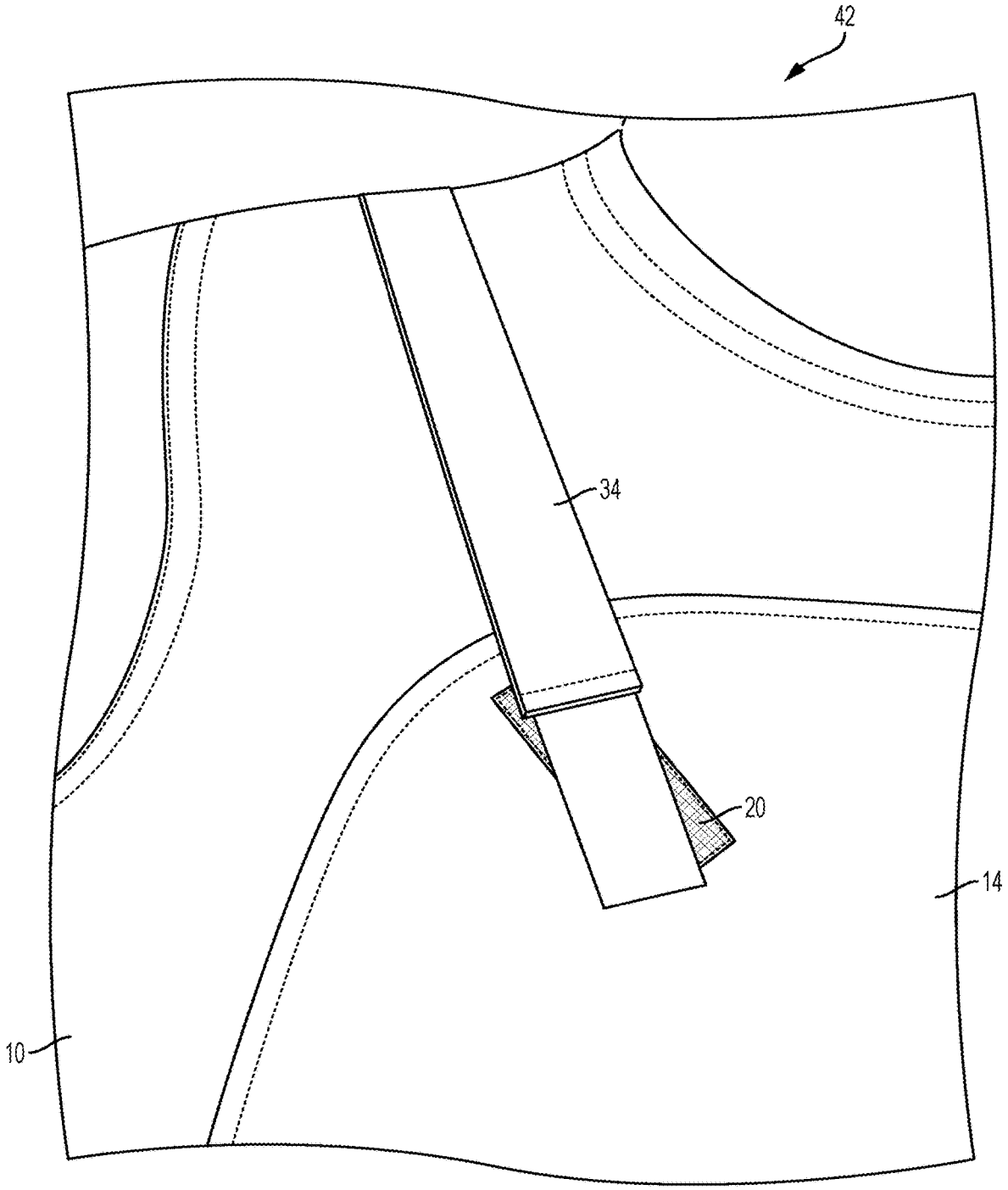
FIG. 6 is a detail view of an upper portion of the ballistic shirt system on a wearer, according to the embodiment of FIG. 4.

Referring to FIG. 6, a detail view of an upper portion of the shirt system 42 is shown. In this view, strap 34 located on an upper portion of the outer shirt 24 (near to the wearer's shoulder in FIG. 4) can be seen after being threaded through the opening 40 or 50 of the outer shirt 24. The strap 34 may rest on the wearer's shoulder and may be attached to connector 20 on the pocket 14 of the inner shirt 10.

Although FIGS. 5 and 6 depict the strap 34 extending around a torso and shoulder, respectively, of a wearer, it is to be understood that the strap 34 may extend around another portion of the wearer's body, such as the chest. Additionally, though Velcro® connectors 48 and 20 are depicted, other known connectors may be used to connect the pockets 14, 38, such as a hook-and-pile fastener, a button, a zipper, a strap, an adjustable strap, a tie, buckle, or a clip.

Figure 7:
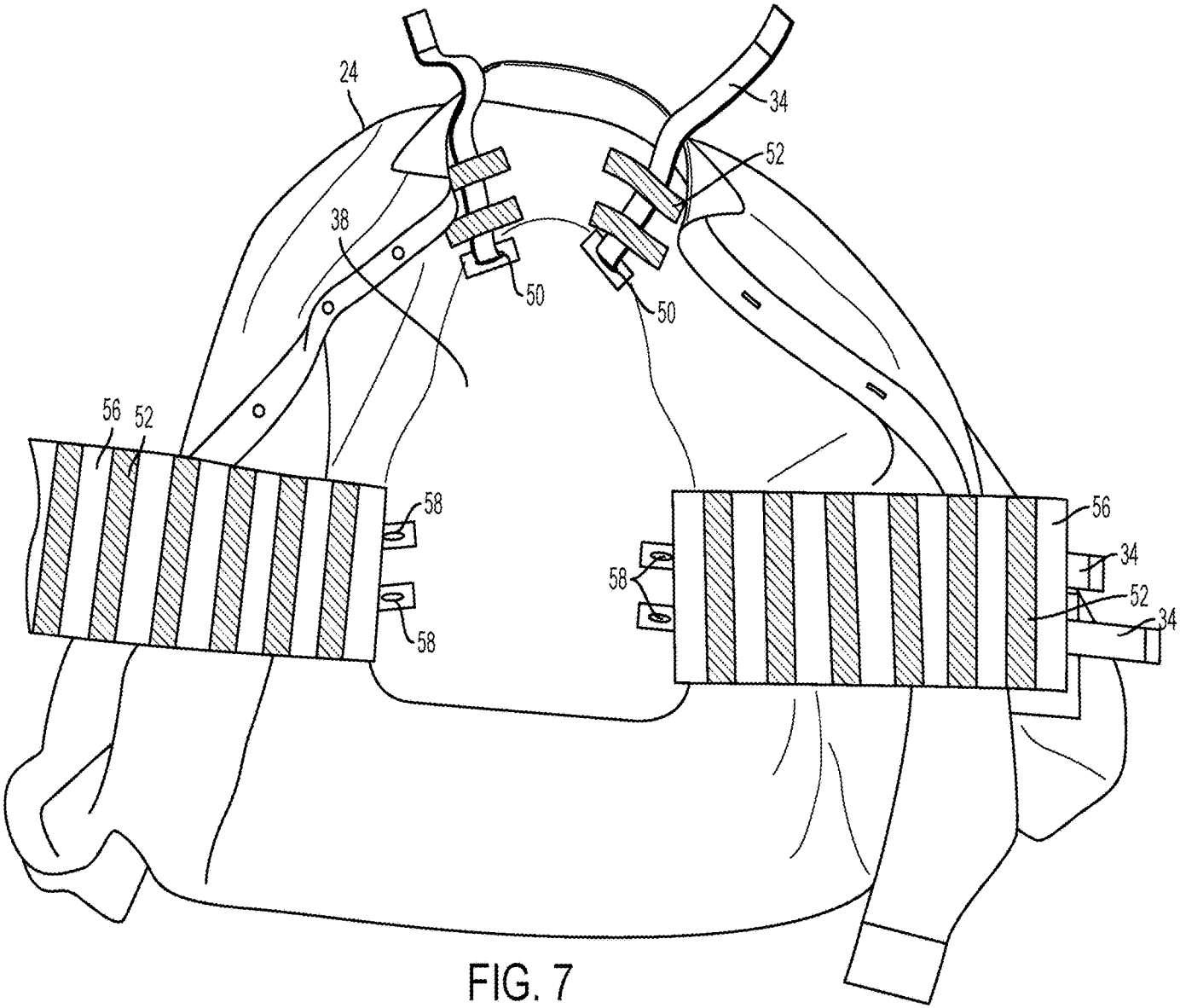
FIG. 7 is a front view of an outer shirt including side ballistic panels.
Figure 7A:
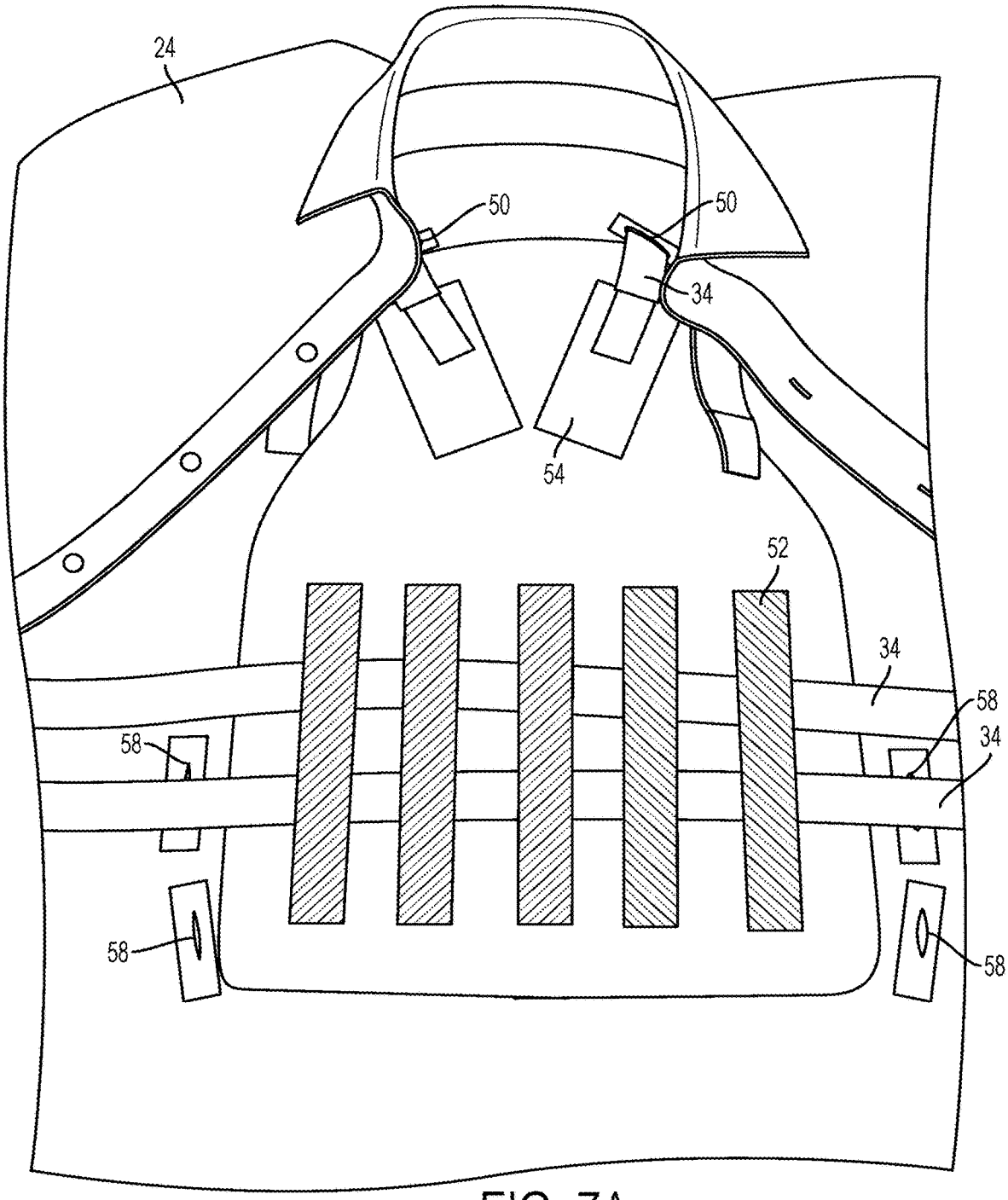
FIG. 7A is a front view of a ballistic panel of an outer shirt of FIG. 2.
Figure 8:
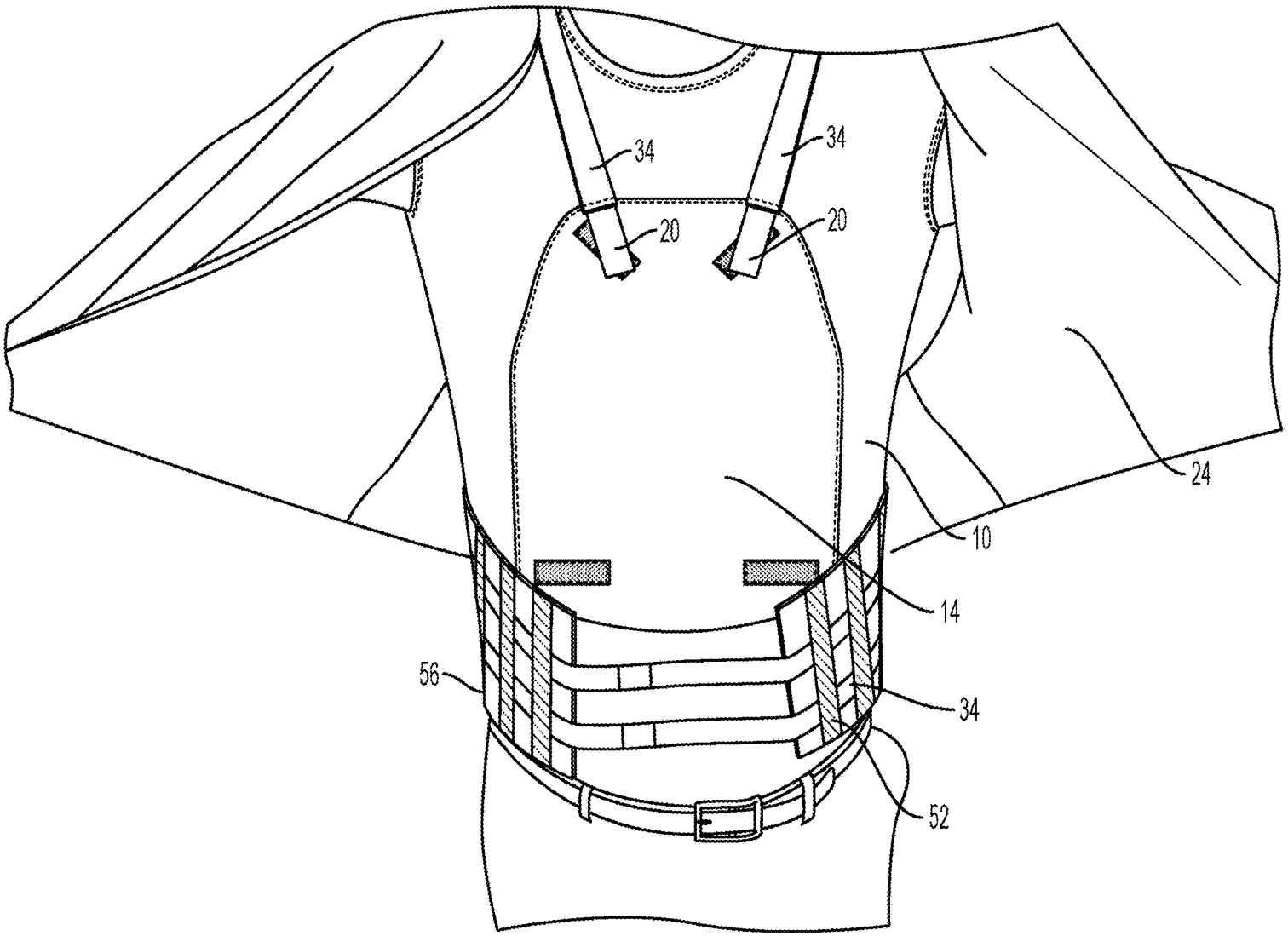
FIG. 8 is a front view of a ballistic shirt system including side ballistic panels, according to an embodiment, clothing a wearer.

Additionally, as shown in FIG. 7, side ballistic panels 56 may be provided. According to embodiments, the side ballistic panels 56 may be one or more of the materials: para-aramid synthetic fiber, ultra-high-molecular-weight polyethylene, and ballistic material. Side ballistic panels 56 may have woven webbing (such as MOLLE) strips 52 located on an inner (FIG. 7) and outer surface (FIG. 8). Referring to FIG. 7A, the ballistic panel 46 is shown outside of outer shirt 24. The ballistic panel 46 may be provided with woven webbing strips 52. Any number of strips 52 may be provided on the side ballistic panels 56 and ballistic panel 46.

Referring again to FIG. 7A, when donning the shirt, straps 34 may be laced through the strips 52 on the ballistic panel 46. Turning now to FIG. 7, the ballistic panel 46 may be inserted into pocket 38 and the straps 34 may be threaded through the openings 58. If upper straps 34 are also to be connected to ballistic panel 46, they may be attached to connectors 54 prior to insertion of the ballistic panel 46 into the pocket 38. The ballistic panel 46 may now be located in the pocket 38 with the straps 34 extending through openings 58 on either side of the outer shirt 24. The straps 34 on a first side of the shirt may be laced through the strips 52 on a side ballistic panel 56. The straps 34 on the other (second) side of the shirt may be laced through the strips 52 on a second side ballistic panel 56. The outer shirt 24 may now be considered assembled and ready to be donned by a wearer. The ballistic panel 46 and side ballistic panels 56 may be assembled to the outer shirt 24 before or after the outer shirt 24 is donned by the wearer.

Although two straps 34 are depicted, more or less straps 34 may be provided as necessary to provide stability for the ballistic panels. The straps 34 provided with the side ballistic panels 56 may extend through strips 52 on the inner side (FIG. 7) or outer side (FIG. 8) of the side ballistic panels 56. Straps 34 may be of adjustable length to accommodate different wearers of the shirt. The straps 34 may have connection points between the side ballistic panel 56 and ballistic panel 46 such that the side ballistic panel may be removed from the shirt system without otherwise removing the shirt or straps. This allows for a wearer to leave straps 34 laced in side ballistic panels 56 and ballistic panel 46 without unlacing the straps 34 to remove the shirt system or launder the shirt. Additionally, this allows for the wearer to add side ballistic panels 56 in desired situations. In these situations, additional straps 34 may be provided to connect pocket 38 to pocket 14 around the torso. This allows for the ballistic panels 44 and 46 to be securely connected even when side ballistic panels 56 are not attached.

Referring to FIG. 8, a shirt system including side ballistic panels 56 is shown donned by a wearer. In the view of FIG. 8, straps 34 laced through strips 52 can be seen on the outer side of the side ballistic panels 56. Alternatively, as previously described, straps 34 may be laced through strips 52 on the inner side of the ballistic panel. Each of the straps 34 for side ballistic panels 56 may comprise opposing ends which are adapted to be connected to one another, such as hard and soft Velcro® ends, buttons, snaps, clips, or buckles. Alternatively, as described with relation to FIGS. 4 and 5, the straps 34 may be attached to connectors 20 of pocket 14. Additionally, the connection for side ballistic panels 56 depicted in FIG. 8 may be provided in addition to the straps 34 of FIG. 3 for securing the pockets 14 and 38 of the inner shirt 10 and outer shirt 24, respectively.

Referring to FIG. 9, a ballistic panel 44 is shown. The ballistic panel 44 may be received in pocket 14 through opening 16. Closing member 18 may secure the ballistic panel 44 within the pocket 14 during use. The ballistic panel 44 may be installed in pocket 14 prior to wearing the inner shirt 10 or alternatively may be installed in the pocket 14 after the wearer has donned the inner shirt 10. According to embodiments, the ballistic panel 44 may be one or more of the materials: para-aramid synthetic fiber, ultra-high-molecular-weight polyethylene, and ballistic material.

Figure 10:
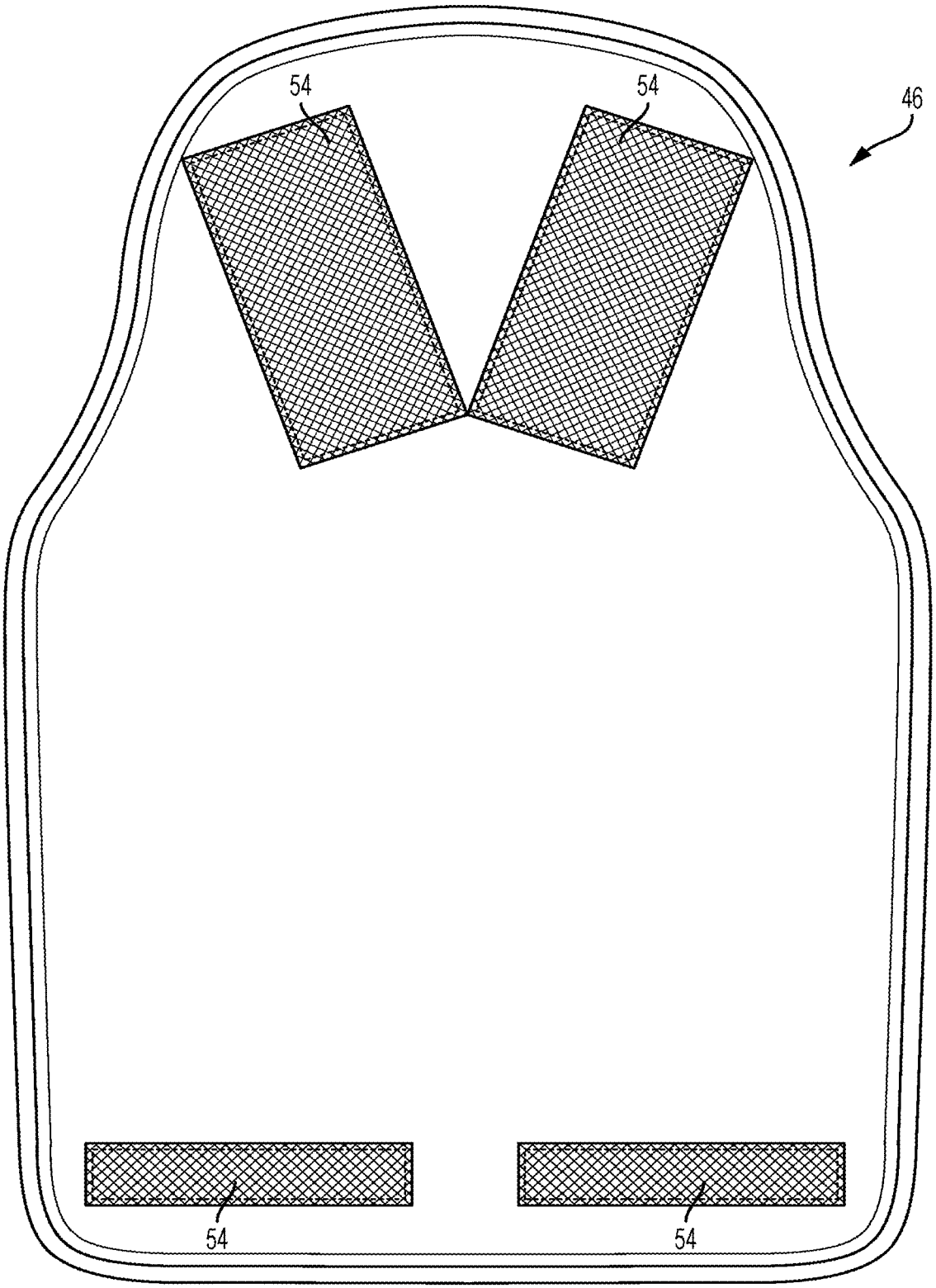
FIG. 10 is a front view of a ballistic panel for an outer shirt of a ballistic shirt system, according to an embodiment.

Referring to FIG. 10, a ballistic panel 46 is shown. The ballistic panel 46 may be received in pocket 38 through opening 30. Closing member 32 may secure the ballistic panel 46 within the pocket 38 during use. The ballistic panel 44 may be installed in pocket 38 prior to wearing the outer shirt 24 or alternatively may be installed in the pocket 38 after the wearer has donned the outer shirt 24. According to embodiments, the ballistic panel 46 may be one or more of the materials: para-aramid synthetic fiber, ultra-high-molecular-weight polyethylene, and ballistic material.

Although the present disclosure describes four individual straps 34 for securing pocket 38 to pocket 14, alternative quantities, designs, and attachments of straps 34 may be used. For example, four straps 34 may be provided, however, instead of extending from the left rear shoulder to the left front chest, the strap may cross and extend to the left front torso, the right front torso, or the right front chest. The remaining straps 34 may be crossed or extended to attach to alternative locations as well. It is therefore understood that any number of combinations of strap locations, crossings, or attachments may be provided to achieve the desired securing of the ballistic panels 44 and 46.

Figure 11:
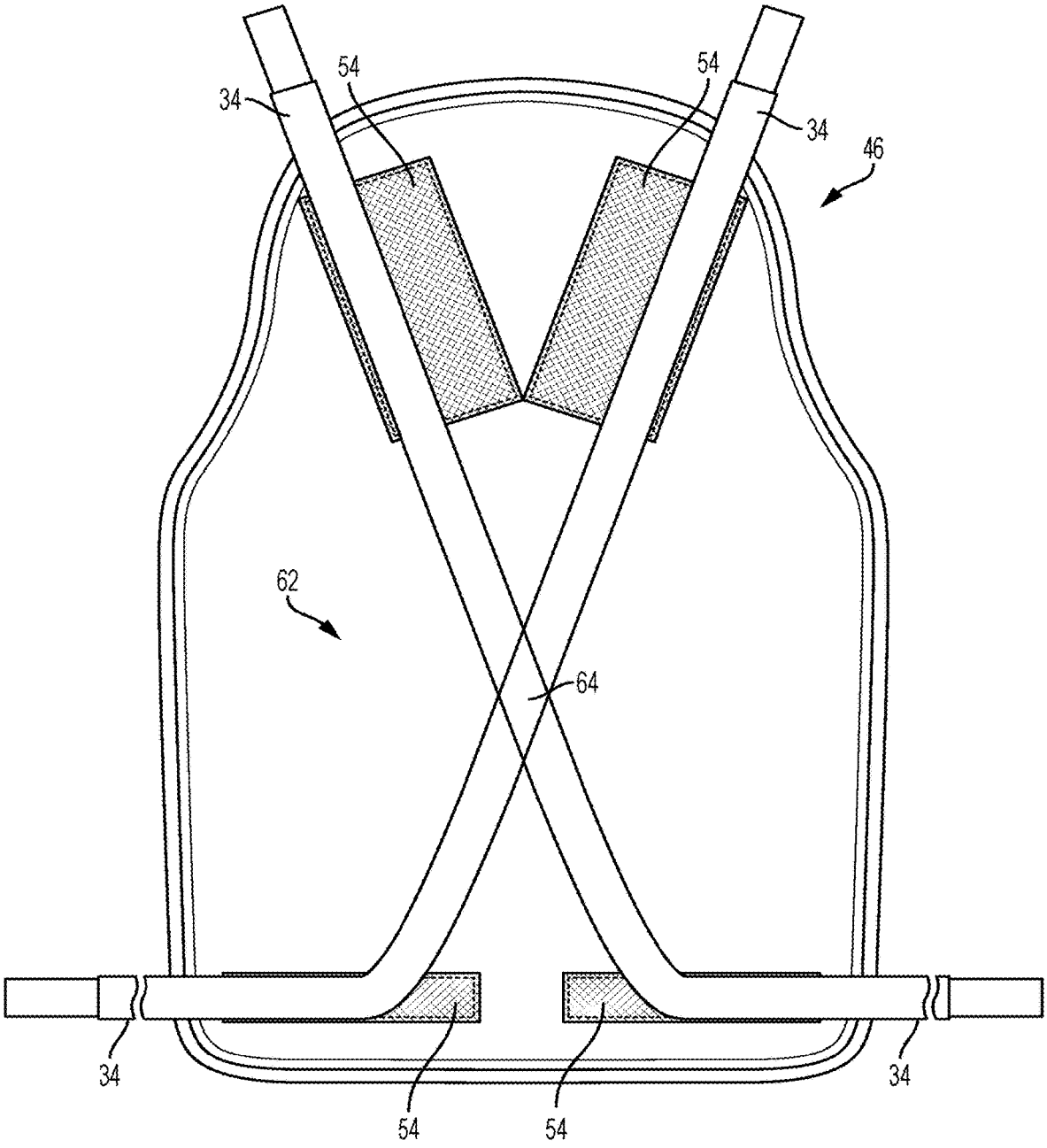
FIG. 11 is a front view of a ballistic panel for an outer shirt of a ballistic shirt system with an alternative strap location, according to an embodiment.

An additional alternative is depicted in FIG. 11 where the straps 34 may be provided as a strap system 62. The strap system 62 may have a connection point 64 from which any number of straps 34 extend. The straps 34 may be unitary in construction or they may be attached to one another at the connection point 64 in a manner known in the art such as adhesion or stitching. FIG. 11 depicts the connection point 64 located on ballistic panel 46. In this embodiment, the straps 34 extend through torso openings 40 and upper openings 50 (see FIG. 3) to connect to the pocket 14 or ballistic panel 44. Alternatively, the connection point 64 may be located on the pocket 38 (FIG. 2) such that the straps 34 extend through upper and lower openings 40 (as depicted in FIG. 2). Similar alternative embodiments for straps 34 may be employed on the pocket 14 of inner shirt 10 or on the ballistic panel 44.

Although described herein with four straps, the shirt system 42 may include more or fewer straps 34. The number, location, and arrangement of straps 34 may be selected to support the weight of the ballistic panels 44, 46. The number, location, and arrangement of straps 34 may be selected to properly orient and locate the ballistic panels 44, 46 on the user. The number, location, and arrangement of straps 34 may allow the ballistic panels 44, 46 to maintain their position when short or otherwise impacted. A person of skill in the art will recognize that the number, location, and arrangement of straps 34 may change based on the particular user, shirt type employed, or activity performed by the user.

Additionally, although described with relation to some embodiments, woven strips 52, or other reinforcing material, fabric, or webbing, may be used in any of the foregoing embodiments and on any of the inner shirt 10 and outer shirt 24. The woven strips 52, or other reinforcing material, fabric, or webbing may be used in any number, orientation, location, or arrangement as necessary to achieve the function of proper use of the ballistic shirt system 24. The woven strips 52, or other reinforcing material, fabric, or webbing, may be selected to hold the ballistic panels 44, 46 in the proper location. The woven strips 52, or other reinforcing material, fabric, or webbing, may be selected to allow the ballistic panels 44, 46 to maintain their position when shot or otherwise impacted. The woven strips 52, other reinforcing material, fabric, or webbing may be used to properly support the weight of ballistic panels 44, 46 or to properly orient and/or locate the ballistic panels 44, 46 on the user.

A person of ordinary skill in the art will recognize the shirt system 42 of the exemplary embodiment provides a ballistic shirt having the appearance of a conventional button-down dress-shirt when worn under a dress coat. According to embodiments incorporating performance breathable material, the shirt system can minimize overheating and sweating. Embodiments additionally provide a lightweight body armor which also protects the wearer while allowing the wearer to move agilely and efficiently as needed. Furthermore, the removeable nature of the ballistic panels 44 and 46 allows a wearer to separately launder the inner shirt 10 and outer shirt 24. Additionally, the connections between the pockets 14, 38 containing the ballistic panels 44, 46 may provide a tight connection between the front and rear ballistic panels that causes them to rest securely on the wearer's body.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A shirt system for supporting body armor, the shirt system comprising:

an inner shirt comprising an inner shirt front panel, an inner shirt rear panel, and an inner shirt pocket attached to the inner shirt front panel;

an outer shirt comprising an outer shirt front panel, an outer shirt rear panel connected to the outer shirt front panel, an outer shirt pocket attached to the outer shirt rear panel, and an outer shirt yoke connected to the outer shirt front panel and the outer shirt rear panel, the outer shirt yoke including an outer shirt yoke opening and the outer shirt rear panel including an outer shirt rear panel opening;

a front ballistic panel of the body armor disposed within the inner shirt pocket;

a rear ballistic panel of the body armor disposed within the outer shirt pocket;

a first strap having a first strap first end of the first strap connected to the inner shirt pocket and a first strap second end, opposite the first strap first end, connected to the outer shirt pocket; and a second strap having a second strap first end connected to the inner shirt pocket and a second strap second end, opposite the second strap first end, connected to the outer shirt pocket, wherein the first strap extends from the inner shirt pocket and through the outer shirt yoke opening to the outer shirt pocket and the second strap extends from the inner shirt pocket and through the outer shirt rear panel opening to the outer shirt pocket, such that the first strap and the second strap provide support to the front ballistic panel disposed within the inner shirt pocket and the rear ballistic panel disposed within the outer shirt pocket.

2. The shirt system of claim 1, wherein the outer shirt yoke opening is disposed closer, along the outer shirt yoke, to the outer shirt rear panel than to the outer shirt front panel.

3. The shirt system of claim 1, wherein at least the inner shirt front panel is formed of a first material, and the inner shirt pocket is formed of a second material that is different than the first material.

4. The shirt system of claim 1, wherein the inner shirt is formed of a first material, and the outer shirt is formed of a second material that is different than the first material.

5. The shirt system of claim 1, wherein the outer shirt is one of a dress shirt, a tuxedo shirt, a polo shirt, a short-sleeve shirt, a long-sleeve shirt, a blouse, or a vest.

6. The shirt system of claim 1, wherein the inner shirt further comprises an inner shirt closing member configured to removably secure the front ballistic panel within the inner shirt pocket, and the outer shirt further comprises an outer shirt closing member configured to removably secure the rear ballistic panel within the outer shirt pocket.

7. The shirt system of claim 1, wherein the inner shirt further comprises a first inner shirt connector that removably connects the first strap first end to the inner shirt pocket and a second inner shirt connector that removably connects the second strap first end to the inner shirt pocket.

8. The shirt system of claim 7, wherein the outer shirt further comprises a first outer shirt connector that removably connects the first strap second end to the outer shirt pocket and a second outer shirt connector that removably connects the second strap second end to the outer shirt pocket.

9. The shirt system of claim 1, wherein the first strap first end is connected to an upper portion of the inner shirt pocket and the first strap second end is connected to an upper portion of the outer shirt pocket, and wherein the second strap first end is connected to a lower portion of the inner shirt pocket and the second strap second end is connected to a lower portion of the outer shirt pocket.

10. The shirt system of claim 9, further comprising:

a third strap having a third strap first end connected to the upper portion of the inner shirt pocket and a third strap second end, opposite the third strap first end, connected to the upper portion of the outer shirt pocket; and a fourth strap having a fourth strap first end connected to the lower portion of the inner shirt pocket and a fourth strap second end, opposite the fourth strap first end, connected to the lower portion of the outer shirt pocket, wherein the outer shirt yoke further includes another outer shirt yoke opening that receives the third strap, and the outer shirt rear panel further includes another outer shirt rear panel opening that receives the fourth strap.

11. The shirt system of claim 1, wherein each of the first strap and the second strap extends from an exterior surface of the outer shirt, through the respective outer shirt yoke opening or the outer shirt rear panel opening, to an interior surface of the outer shirt.

12. The shirt system of claim 11, wherein the inner shirt pocket is disposed along an exterior surface of the inner shirt, and the outer shirt pocket is disposed along the exterior surface of the outer shirt.

13. The shirt system of claim 1, wherein the outer shirt front panel comprises a first outer shirt front panel and a second outer shirt front panel that are connected to the outer shirt rear panel and the outer shirt yoke.

14. The shirt system of claim 13, wherein the outer shirt further comprises an outer shirt collar connected to the outer shirt yoke, the first outer shirt front panel, and the second outer shirt front panel.

15. The shirt system of claim 14, wherein the outer shirt yoke opening is disposed along the outer shirt yoke between the outer shirt collar and the outer shirt rear panel.

16. The shirt system of claim 15, wherein the outer shirt yoke opening is disposed closer, along the outer shirt yoke, to the outer shirt rear panel than to the outer shirt collar.

17. A shirt system for supporting body armor, the shirt system comprising:

an inner shirt comprising an inner shirt front panel, an inner shirt rear panel, and an inner shirt pocket attached to the inner shirt front panel;

an outer shirt comprising a first outer shirt front panel, a second outer shirt front panel, an outer shirt rear panel connected to the first outer shirt front panel and the second outer shirt front panel, and an outer shirt pocket attached to the outer shirt rear panel, the outer shirt including a first outer shirt opening, a second outer shirt opening, a third outer shirt opening, and a fourth outer shirt opening, the outer shirt rear panel including at least the second outer shirt opening and the fourth outer shirt opening;

a front ballistic panel of the body armor removably received within the inner shirt pocket;

a rear ballistic panel of the body armor removably received within the outer shirt pocket;

a first strap having a first strap first end and a first strap second end;

a second strap having a second strap first end and a second strap second end;

a third strap having a third strap first end and a third strap second end; and a fourth strap having a fourth strap first end and a fourth strap second end, wherein the first strap and the third strap extend from the inner shirt pocket and through the first outer shirt opening and the third outer shirt opening, respectively, to the outer shirt pocket, the first strap first end and the third strap first end being connected to an upper portion of the inner shirt pocket and the first strap second end and the third strap second end being connected to an upper portion of the outer shirt pocket, wherein the second strap and the fourth strap extend from the inner shirt pocket and through the second outer shirt opening and the fourth outer shirt opening, respectively, to the outer shirt pocket, the second strap first end and the fourth strap first end being connected to a lower portion of the inner shirt pocket and the second strap second end and the fourth strap second end being connected to a lower portion of the outer shirt pocket, and wherein the first strap, the second strap, the third strap, and the fourth strap provide support to the front ballistic panel disposed within the inner shirt pocket and the rear ballistic panel disposed within the outer shirt pocket.

18. The shirt system of claim 17, wherein the outer shirt further comprises an outer shirt yoke connected to the outer shirt rear panel, the first outer shirt front panel, and the second outer shirt front panel, the outer shirt yoke including the first outer shirt opening and the third outer shirt opening.

19. The shirt system of claim 18, wherein the first outer shirt opening is disposed closer, along the outer shirt yoke, to the outer shirt rear panel than to the first outer shirt front panel, and the third outer shirt opening is disposed closer, along the outer shirt yoke, to the outer shirt rear panel than to the second outer shirt front panel.

20. The shirt system of claim 17, wherein the inner shirt is formed of a first material, and the outer shirt is formed of a second material that is different than the first material.

* * * * *